US006401676B1

(12) United States Patent
Tsukui

(10) Patent No.: US 6,401,676 B1
(45) Date of Patent: Jun. 11, 2002

(54) VALVE DEVICE HAVING VALVE RESTING MECHANISM USED FOR INTERNAL COMBUSTION ENGINE

(75) Inventor: Takaaki Tsukui, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,161

(22) Filed: Sep. 14, 1999

(30) Foreign Application Priority Data

Sep. 14, 1998 (JP) ..... 10-260679

(51) Int. Cl.[7] ..... F01L 13/00

(52) U.S. Cl. ..... 123/90.16; 123/90.48; 123/198 F

(58) Field of Search ..... 123/90.12, 90.15, 123/90.16, 90.48, 198 F

(56) References Cited

U.S. PATENT DOCUMENTS 5,163,389 A * 11/1992 Fujikawa ..... 123/90.16
5,233,951 A * 8/1993 Hausknecht ..... 123/90.12
5,327,858 A * 7/1994 Hausknecht ..... 123/90.12
5,485,813 A * 1/1996 Molitor et al. ..... 123/90.12
5,488,934 A * 2/1996 Shirai ..... 123/90.16
5,603,293 A * 2/1997 Schwarzenthal ..... 123/90.16
5,603,294 A * 2/1997 Kawai ..... 123/90.16
5,615,651 A * 4/1997 Miyachi ..... 123/198 F
5,709,180 A * 1/1998 Spath ..... 123/90.16

FOREIGN PATENT DOCUMENTS

JP 7259520 10/1995

* cited by examiner

*Primary Examiner*—Weilun Lo
(74) *Attorney, Agent, or Firm*—Birch, Stewart, Kolasch & Birch, LLP

(57) ABSTRACT

A valve resting mechanism, for use with an internal combustion engine, which is capable of facilitating assembly of a valve lifter in the valve device. A valve device having a valve resting mechanism used for an internal combustion engine is configured such that a valve lifter having a lost motion mechanism is interposed between a cam and a stem of a poppet valve; the valve lifter is usually biased by a lifter spring in the direction in which the valve lifter is engaged with the cam; and a peripheral groove is provided for introducing hydraulic pressure for driving the lost motion mechanism is formed in an inner peripheral surface of a valve lifter hole for slidably guiding the valve lifter. In this valve device, the valve lifter, the lifter spring, and the peripheral groove are formed in such a manner that a lower end A of the valve lifter is positioned under a lower end of the peripheral groove in a state in which the lifter spring is freely extended.

18 Claims, 7 Drawing Sheets

VALVE DEVICE HAVING VALVE RESTING MECHANISM USED FOR INTERNAL COMBUSTION ENGINE

BACKGROUND OF THE INVENTION

1. Field of the Invention

The present invention relates to a valve device having a valve resting mechanism used for an internal combustion engine, and particularly to the valve device in which a valve lifter having a lost motion mechanism is interposed between a cam and a stem of a poppet valve.

2. Description of Background Art

With respect to an internal combustion engine of a type in which a plurality of intake valves or exhaust valves are provided in one cylinder, there is known a technique in which a valve resting mechanism is provided for at least one of the intake (exhaust) valves for holding the intake (exhaust) valve at the close position irrespective of operation of a cam. With this configuration, all of the intake (exhaust) valves are opened/closed in an intermediate/high intake amount operation region, for example, upon intermediate/high speed rotation or intermediate/high load operation of the internal combustion engine, and the valve having the valve resting mechanism is kept in the resting or closing state in a low intake amount operation region, for example, upon low speed rotation or low load operation of the engine.

A valve device having a valve resting mechanism has been disclosed, for example, in Japanese Patent Laid-open No. Hei 7-259520. This valve device is configured such that a valve lifter (tappet), which is interposed between a cam and a stem of a poppet valve, is usually biased by a (compressive) spring in the direction in which the valve lifter is engaged with the cam. A plunger (connecting member) is provided in the valve lifter in such a manner as to be slidable in the direction of a diameter of the valve lifter. The plunger is biased in one direction by a compressive spring provided in contact with one end of the plunger, and the other end of the plunger is received by a piston disposed coaxially with the plunger. The plunger has a hole in or from which the valve stem is movable.

When the piston is at the retreated position, even if the hole is aligned with the stem and the valve lifter is moved up and down by the cam, the stem is only moved in or from the hole and thereby the vertical motion of the valve lifter is not transmitted to the valve. To be more specific, the valve is kept at the close position irrespective of the motion of the cam by the lost motion mechanism composed of the plunger, piston and compressive spring. The piston is driven by a hydraulic pressure, and when the piston projects from the retreated position, the plunger is slid against the compressive spring and the hole is deviated from the stem, so that an upper end of the stem is locked with the plunger in a state being in contact with a lower surface of the plunger. Accordingly, the valve is driven by the cam via the valve lifter.

In the valve device of the type in which the lost motion mechanism in the valve lifter is driven by a hydraulic pressure, as shown in FIG. 7, a peripheral groove 03 for introducing the hydraulic pressure is generally formed in an inner peripheral surface of a valve lifter hole 02 for slidably guiding a valve lifter 01.

In FIG. 7, reference numeral 04 designates a plunger, and 05 is a compressive spring for biasing the plunger. A hydraulic pressure is directly applied to an end surface of the plunger 04 via an oil hole 06 provided in the valve lifter 01.

The valve lifter 01 is biased upwardly by a valve lifter spring 07, but is pushed down by a cam 08.

The valve lifter 01 is assembled to an upper position of the stem 09 in a state before the cam shaft is assembled, that is, in a state in which the cam 08 is not present over the stem 09. Specifically, the valve lifter 01 is inserted from above into the valve lifter hole 02, and is placed on and supported by an upper end of the spring 07 which freely extends upwardly with its lower end supported by the cylinder head. Upon assembly of the cam shaft, the valve lifter 01 is pushed down by the cam 08, and is located at the position shown in FIG. 7 while compressing the spring 07.

In this way, the valve lifter 01 is initially placed on the freely extending spring 07, and accordingly, as shown in FIG. 8, a lower end 01*a* of the valve lifter 01 is located over a lower end 03*a* of the peripheral groove 03. As a result, when the valve lifter 01 is pushed down by the cam 08, as shown in FIG. 9, the valve lifter 01 is slightly tilted, and thereby the lower end 01*a* of the valve lifter 01 enters in the peripheral groove 03 and bits the lower end 03*a* thereof. This may obstruct the assembly of the valve lifter 01 from being smoothly performed.

In particular, the above inconvenience may easily occur if the assembling direction of the cam shaft is different from the extending direction of the valve stem, and in this case the assembly of the valve lifter must be performed with its tilting state corrected by means of a jig or the like. This complicates the step of assembling the valve lifter.

SUMMARY AND OBJECTS OF THE INVENTION

In view of the foregoing, the present invention has been made, and according to the present invention, there is provided a valve device having a valve resting mechanism used for an internal combustion engine, in which a valve lifter having a lost motion mechanism is interposed between a cam and a stem of a poppet valve. The valve lifter is usually biased by a spring in the direction in which the valve lifter is engaged with the cam. A peripheral groove, adapted to introduce hydraulic pressure for driving the lost motion mechanism, is formed in an inner peripheral surface of a valve lifter hole for slidably guiding the valve lifter. The valve lifter, the spring, and the peripheral groove are formed in such a manner that a lower end of the valve lifter is positioned under a lower end of the peripheral groove in a state in which the spring is freely extended.

According to the present invention, the lower end of the valve lifter supported on the freely extending spring is located below the lower end of the peripheral groove at the initial state of assembly of the valve lifter. With this configuration, when being pushed down by the cam upon assembly of the cam shaft, the valve lifter does not bite the peripheral groove. This makes it possible to smoothly assemble the valve lifter and the cam shaft.

The above function and effect are particularly advantageously and significantly achieved for the valve device of the present invention, which is characterized in that the assembling direction of the cam shaft is different from the extending direction of the valve stem.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
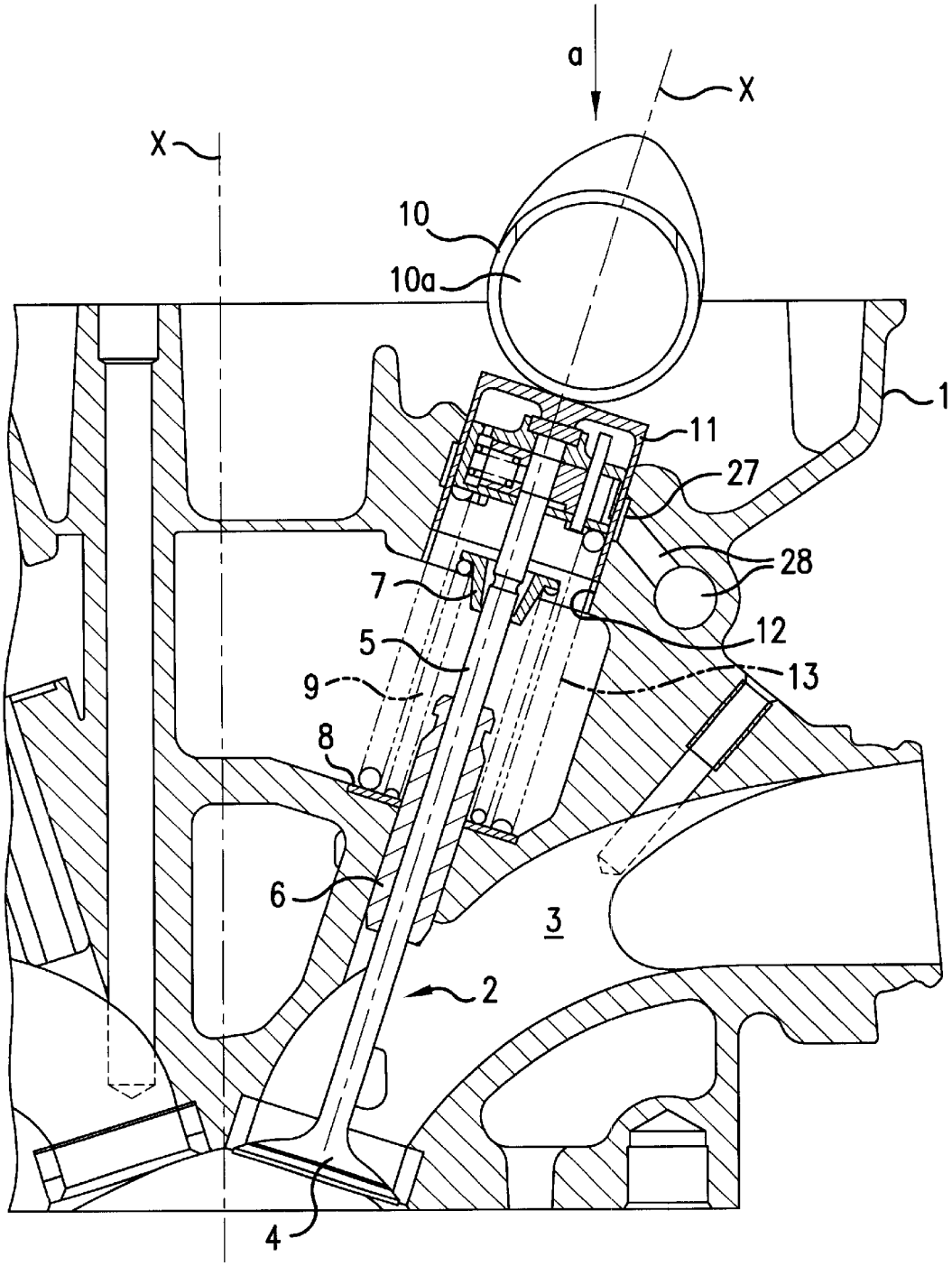
FIG. 1 is a vertical sectional view showing part of a cylinder head of an internal combustion engine, which includes a valve device of the present invention.

Hereinafter, one embodiment of the present invention will be described with reference to FIGS. 1 to 6. FIG. 1 is a vertical sectional view showing part of a cylinder head 1 of an internal combustion engine. A valve device 2 of the present invention is mounted in the cylinder head 1.

In the embodiment shown in FIGS. 1 to 6, the valve device 2 is an intake valve, configured as a poppet valve 4, for opening/closing an intake passage 3. A stem 5 of the poppet valve 4 extends upwardly while slidably passing through a valve guide 6 fixed to the cylinder head 1. A valve spring 9 is contracted between a spring retainer 7 fixed on an upper portion of the stem 5 and a spring supporting plane 8 formed in the cylinder head 1, and the poppet valve 4 is biased upwardly by the valve spring 9 in such a manner as to be kept in the closed position. A cam 10, positioned over the stem 5, is mounted to a cam shaft 10*a*. A valve lifter 11 is interposed between the cam 10 and the stem 5.

The valve lifter 11 is inserted in a valve lifter hole 12 provided in the cylinder head 1 in such a manner as to be slidable in the axial direction of the valve stem 5. A lifter spring 13 is contracted between the spring supporting plane 8 of the cylinder head 1 and the valve lifter 11. The valve lifter 11 is biased upwardly by the lifter spring 13 and is pushed from above by the cam 10.

Figure 2:
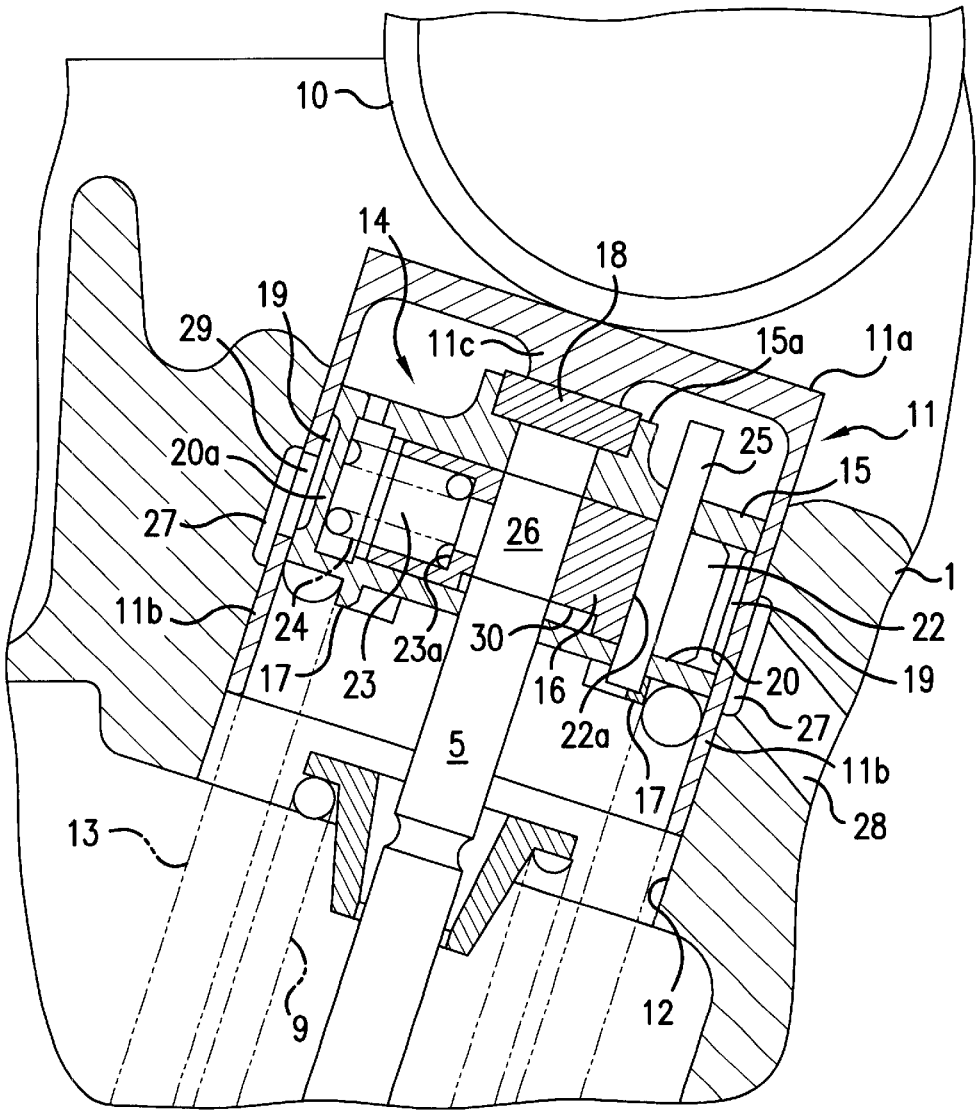
FIG. 2 is an enlarged view showing an essential portion shown in FIG. 1.
Figure 3:
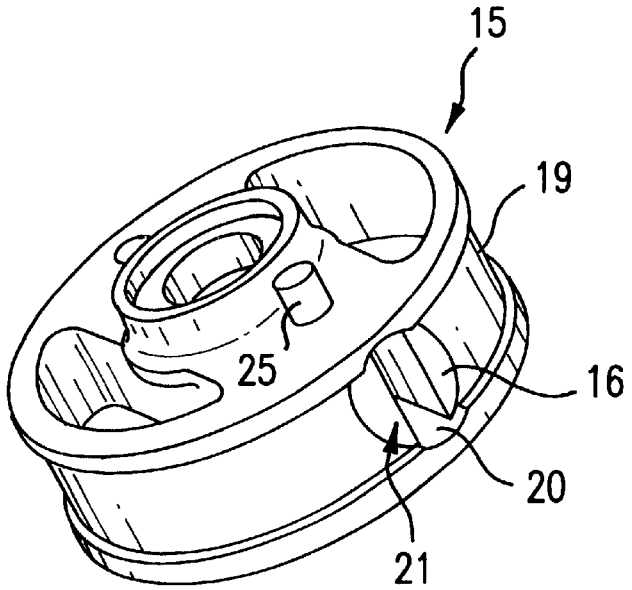
FIG. 3 is a perspective top view of a plunger holding body in which a plunger is assembled.
Figure 4:
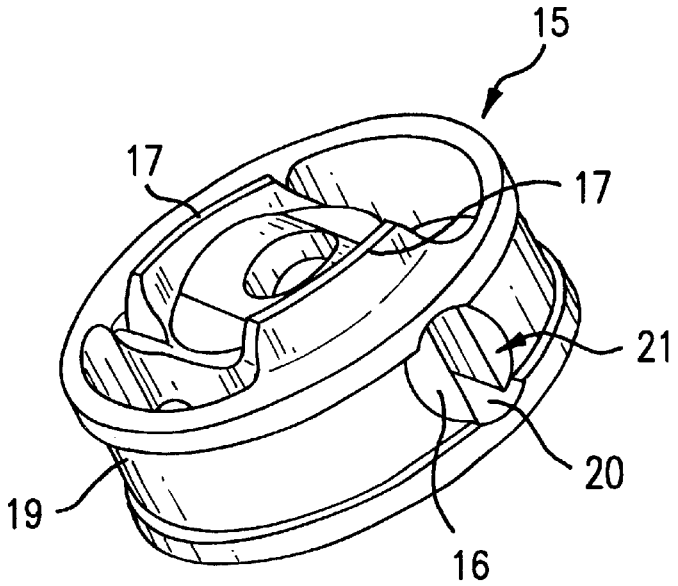
FIG. 4 is a perspective bottom view of the plunger holding body shown in FIG. 3.
Figure 5:
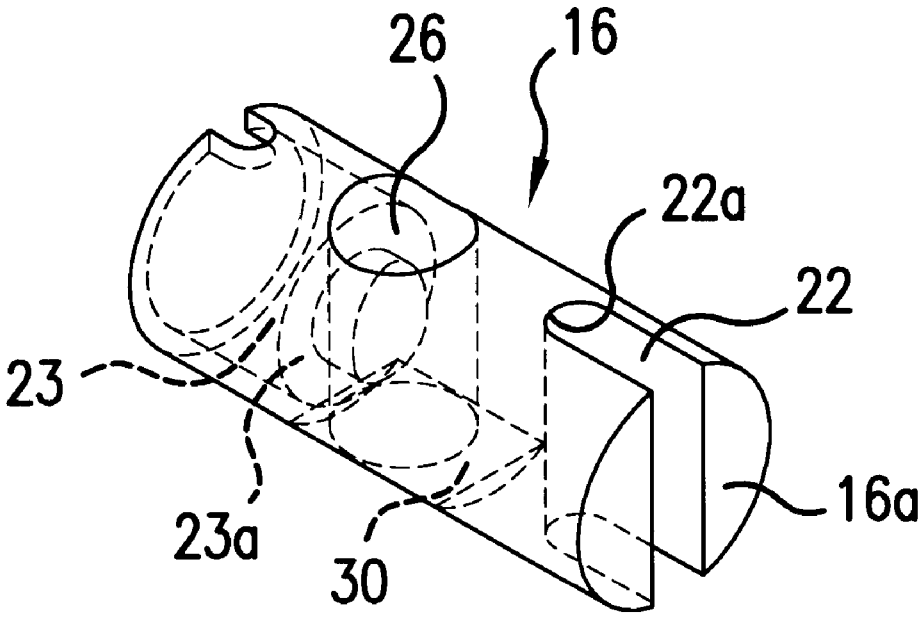
FIG. 5 is a perspective view of the plunger.

FIG. 2 is an enlarged view of the valve lifter 11 and its neighborhood shown in FIG. 1. The valve lifter 11 includes a lifter main body 11 a formed into a cylinder with a bottom and a lost motion mechanism 14 provided in the main body 11*a*. The lost motion mechanism 14 includes a plunger holding body 15 formed into a cylindrical shape and inserted in the main body 11*a*, and a plunger 16 held in the plunger holding body 15 in such a manner as to be slidable in the direction of the diameter of the plunger holding body 15. FIGS. 3 and 4 are perspective top and bottom views of the plunger holding body 15 in which the plunger 16 is assembled, respectively, and FIG. 5 is a perspective view of the plunger 16.

A pair of right and left ribs 17 are provided that project from a bottom surface of the plunger holding body 15 at positions near the center of the plunger holding body 15. The lifter spring 13 is engaged with the bottom surface of the plunger holding body 15 while being located between the ribs 17 and a peripheral wall portion 11*b* of the lifter main body 11*a*. A ring-shaped projection 15*a* is provided at a central portion on an upper surface of the plunger holding body 15. An adjusting piece 18 is inserted in the ring-shaped projection 15*a*. A projecting portion 11*c*, which is provided on the back surface of a top wall of the lifter main body 11*a*, is engaged with an upper surface of the adjusting piece 18. In this way, the lifter main body 11*a* is biased upwardly by the lifter spring 13 via the plunger holding body 15 and the adjusting piece 18. In addition, an annular groove 19 is formed over the peripheral surface of the plunger holding body 15.

A plunger hole 20 extending in the direction of the diameter of the plunger holding body 15 is formed in the plunger holding body 15. One end (right end in FIG. 2) of the plunger hole 20 has an opening 21 (see FIGS. 3 and 4), and the other end thereof is closed. The plunger 16 is slidably inserted in the plunger hole 20.

One end portion of the plunger 16 on the opening 21 side has a vertically extending slit portion 22 cut from a flat end surface 16*a* in the axial direction, and the other end of the plunger 16 has a spring containing portion 23 recessed into a cylindrical shape from the end surface of the plunger 16. A return spring 24 is interposed between a bottom wall portion 23*a* of the spring containing portion 23 and a bottom wall portion 20*a* of the plunger hole 20. On the opening 21 side, a stopper pin 25 is provided on the plunger holding body 15 in such a manner so as to pass through the plunger hole 20 in the vertical direction and also passes through the slit portion 22. Accordingly, the plunger 16 pushed to the opening 21 side by the return spring 24 is located at a position where the stopper pin 25 is in contact with a bottom portion 22*a* of the slit portion 22. The position is a lost motion position where a stem passing hole 26 passing through the plunger 16 in the vertical direction is aligned with the valve stem 5 on the lower side. In this case, even if the valve lifter 11 is moved up and down by the cam 10, the stem 5 is moved in and from the stem passing hole 2, with a result that the vertical motion of the valve lifter 11 is not transmitted to the stem 5, that is, to the poppet valve 4.

A peripheral groove 27 is formed in an inner peripheral surface of the valve lifter hole 12. The peripheral groove 27 is communicated to an oil passage 28 formed n the cylinder head 1, Hydraulic pressure is introduced to or discharged from the oil passage 28 via a hydraulic control unit (not shown). The peripheral groove 27 is communicated to the opening 21 via an oil passing hole 29 provided in the peripheral wall portion 11*b* of the lifter main body 11*a* and the annular groove 19 of the plunger holding body 15. When hydraulic pressure is introduced to the oil passage 28, the plunger 16 is retreated while compressing the return spring 24 by the hydraulic pressure applied to the end surface of the plunger 16 on the opening 21 side, so that the stem passing hole 26 is deviated from the stem 5. In this state, since a flat contact plane 30 extending to the opening 21 side is formed on the plunger 16 in such a manner as to be adjacent to a lower end of the stem passing hole 26, an upper end of the stem 5 biased upwardly by the valve spring 9 is brought into contact with and engaged with the contact plane 30. As a result, the valve lifter 11 is coupled with the stem 5 and thereby the vertical motion of the valve lifter 11 is directly transmitted to the stem 5, that is, to the poppet valve 4. When the hydraulic pressure in the oil passage 28 is discharged, the plunger 16 is returned again to the above-described lost motion position by the return spring 24.

The above-described valve device 2 is assembled in the cylinder head 1 as follows. First, the poppet valve 4 is assembled at a specific position in a state being supported by the valve spring 9, and the lifter spring 13 located outside the valve spring 9 is self-supported on the spring supporting plane 8. Then, the valve lifter 11 is inserted from above into the valve lifter hole 12 of the cylinder head 1, and is placed on the lifter spring 13 kept in the freely extended state. The above operation is carried out before assembly of the cam shaft lea, that is, in a state in which the cam 10 is not mounted.

Figure 6:
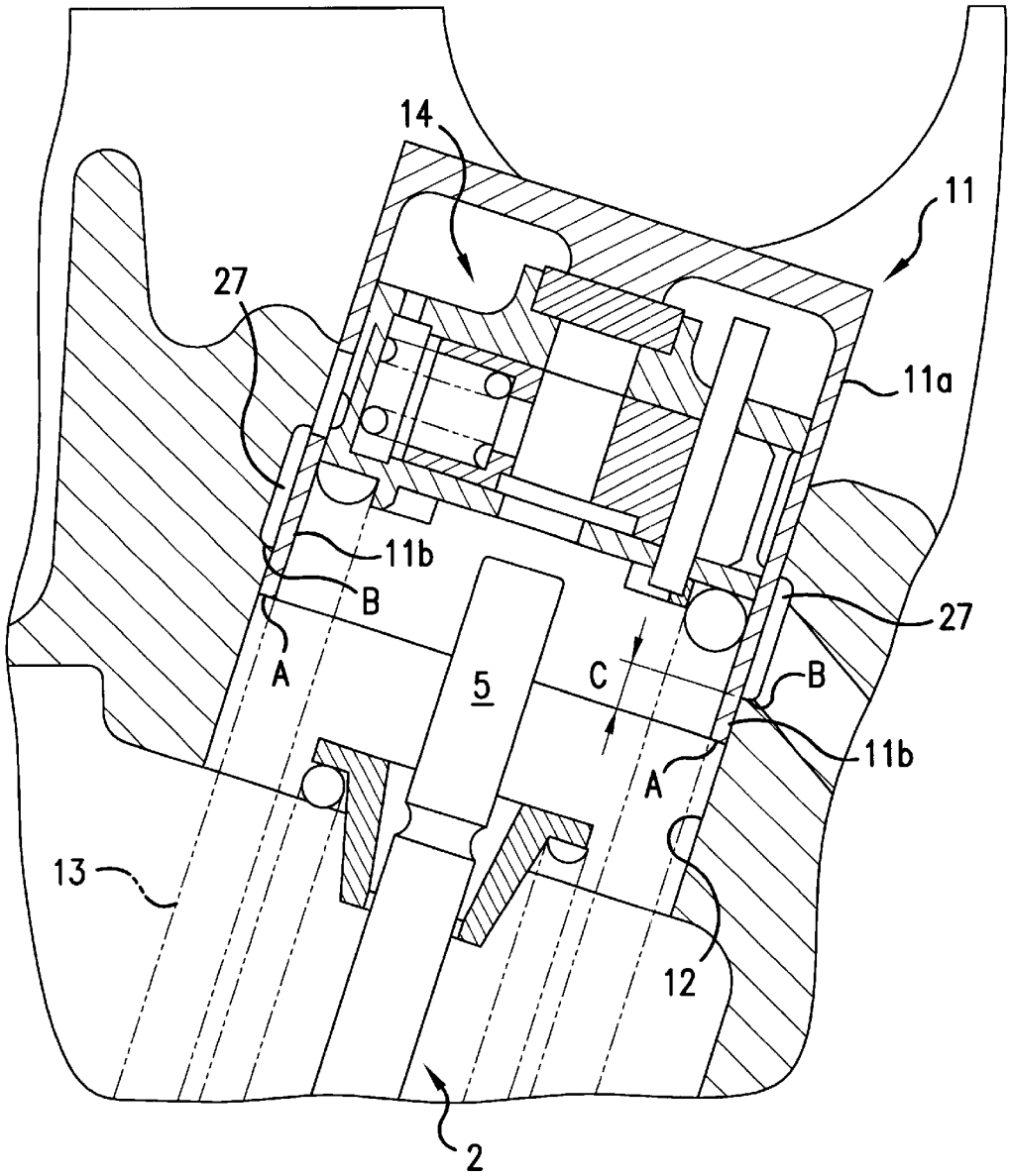
FIG. 6 illustrates a view, similar to FIG. 2, showing a state of the valve device in which a valve lifter is assembled.
Figure 7:
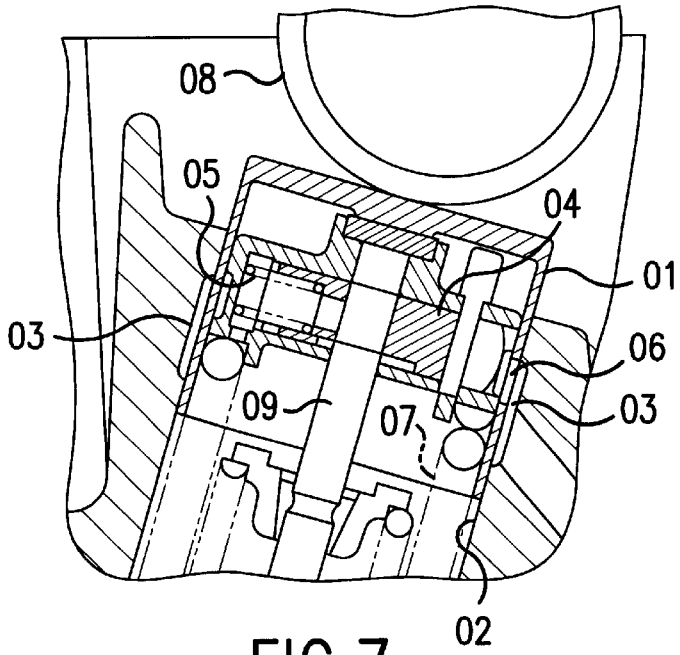
FIG.7 PRIOR ART
FIG. 7 illustrates a sectional view of a prior art valve device.
Figure 8:
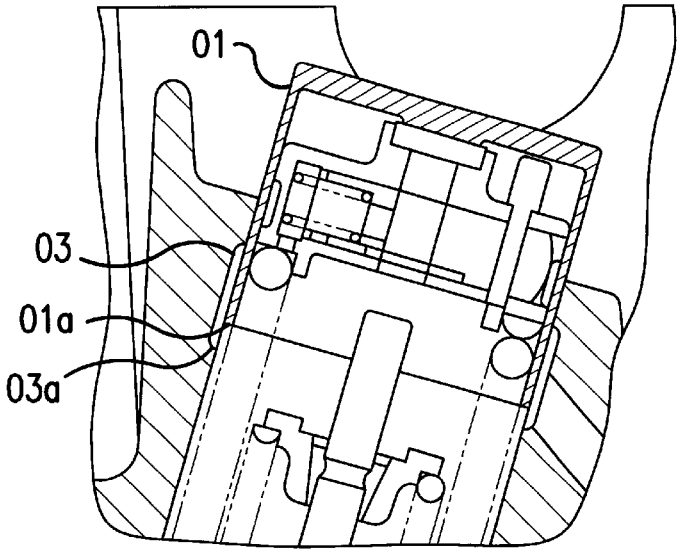
FIG.8 PRIOR ART
FIG. 8 illustrates a view showing a state of the prior art valve device in which the valve lifter is assembled.
Figure 9:
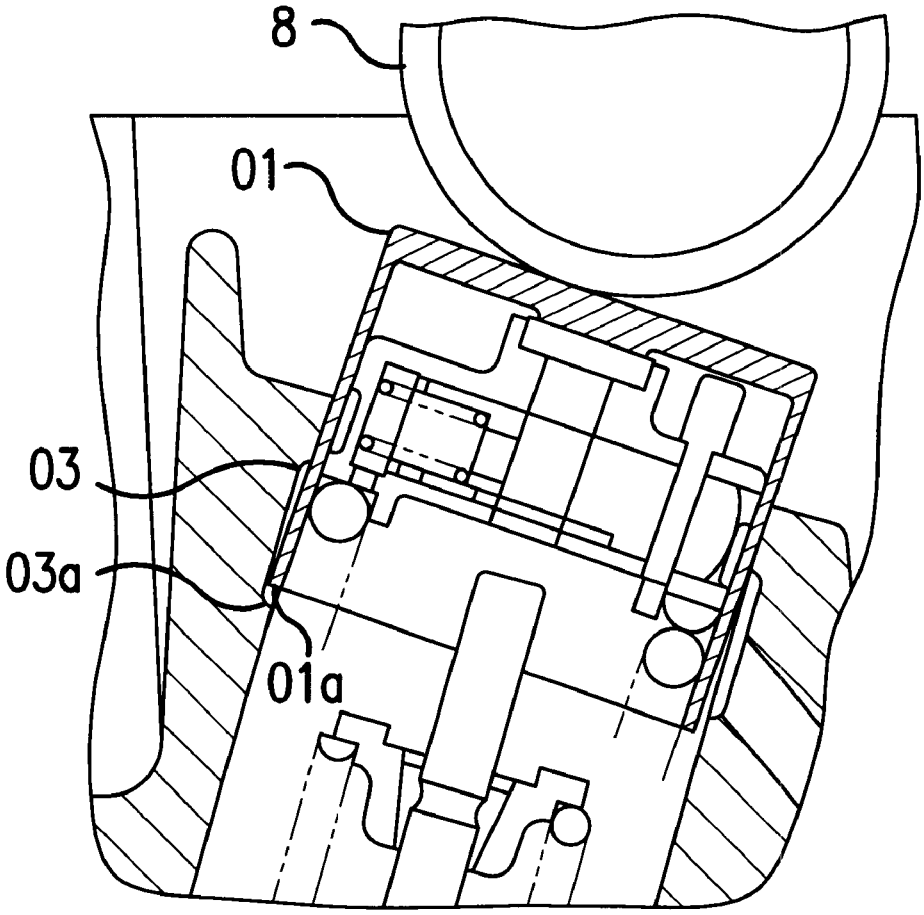
FIG.9 PRIOR ART
FIG. 9 illustrates a view, similar to FIG. 8, showing the valve lifter tilted in the assembling work of the prior art valve device.

FIG. 6 shows the above-described state of the valve device 2, in which the lifter spring 13 is substantially perfectly extended and thereby the valve lifter 11 projects upwardly from the valve lifter hole 12. In the embodiment of the present invention, however, even in such a state, a lower end A of the peripheral wall portion 11*b* of the lifter main body 11*a* is located below a lower end B of the peripheral groove 27, that is, the entire periphery of the lower portion of the peripheral wall portion 11*b* extends over the inner peripheral surface of the valve lifter hole 12 in such a manner as to be offset downwardly from the lower end B of the peripheral groove 27 by a height C.

The cam shaft 10*a* is then assembled from above to below. At this time, the upper end surface of the valve lifter 11 is brought into contact with the cam 10 to be pushed down. Such a state is shown in FIGS. 1 and 2. In this state, since the lower end portion of the peripheral wall portion 11*b* of the valve lifter 11 extends over the inner peripheral surface of the valve lifter hole 12 in such a manner as to be initially located under the peripheral grooves 27, the valve lifter 11 is very smoothly pushed down up to a specific position without the occurrence of an inconvenience wherein the lower end A of the peripheral wall portion 11*b* bites the peripheral groove 27 or is caught by the lower end B of the peripheral groove 27. The above overlapped height C can be easily set by suitably selecting dimensions of the peripheral groove 27, the peripheral wall portion 11*b* and the lifter spring 13.

In this embodiment, as shown in FIG. 1, while an axial line x of the valve stem 5 is tilted with respect to a vertical axial line X of the cylinder head 1, the cam shaft 10*a* is assembled along the vertical axial line X as shown by an arrow a. As a result, when the valve lifter 11 is pushed down by the cam 10, a force for tilting the valve lifter 11 is applied to the valve lifter 11. Even in this case, according to this embodiment, the valve lifter 11 can be smoothly assembled because the overlapped height C is initially provided as described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve lifter for use between a cam and a stem of a poppet valve comprising:

a spring for normally biasing said valve lifter in a direction wherein said valve lifter is engaged with a cam;

a lost motion mechanism operatively disposed within said valve lifter; and a peripheral groove formed in a cylinder head and adapted for introducing hydraulic pressure for driving said lost motion mechanism;

said valve lifter, said spring, and said peripheral groove are formed wherein a distal end of said valve lifter is positioned to extend past a lower end of said peripheral groove in a state wherein said spring is freely extended.

2. The valve lifter according to claim 1, wherein an assembling direction of a cam shaft is different from the extending direction of said valve stem.

3. The valve lifter according to claim 1, wherein said valve lifter includes a main body formed to include an opening within a central portion of said main body, said lost motion mechanism being disposed for reciprocation within the central portion of said main body in a direction substantially orthogonal to said stem of said poppet valve.

4. The valve lifter according to claim 3, wherein said main body extends a predetermined distance between a cam and a stem of a poppet valve and said distal end of said valve lifter is disposed below said peripheral groove in a state wherein the spring is freely extended.

5. The valve lifter according to claim 1, wherein said lost motion mechanism includes a plunger holding body and a plunger operatively disposed to be slidable within said plunger holding body, said plunger being displaced to slide within said plunger holding body in response to hydraulic pressure being applied thereto.

6. The valve lifter according to claim 5, and further including a means for biasing said plunger to a predetermined position for enabling a stem to pass through a stem passing hole in said plunger holding body to not permit the transmission of motion from a cam to a poppet valve.

7. The valve lifter according to claim 6, wherein a predetermined hydraulic pressure applied to said plunger imparts sliding movement thereto to block a stem from passing through a stem passing hole in said plunger holding body to permit transmission of motion from a cam to a poppet valve.

8. The valve lifter according to claim 1, wherein said peripheral groove is formed in an inner surface of a valve lifter hole and said valve lifter includes an aperture for communicating hydraulic pressure from said peripheral groove to said lost motion mechanism.

9. The valve lifter according to claim 1, and further including an adjusting piece disposed between said valve lifter and said lost motion mechanism.

10. A valve lifter for use between a cam and a stem of a poppet valve wherein the valve lifter is slidably mounted within a cylinder head comprising:

a spring for normally biasing said valve lifter in a direction wherein said valve lifter is engaged with a cam;

a lost motion mechanism operatively disposed within said valve lifter; and a peripheral groove formed in a surface of said cylinder head and adapted for introducing hydraulic pressure for driving said lost motion mechanism;

said valve lifter, said spring, and said peripheral groove are formed wherein a distal end of said valve lifter is positioned to extend past a lower end of said peripheral groove in a state wherein said spring is freely extended.

11. The valve lifter according to claim 10, wherein an assembling direction of a cam shaft is different from the extending direction of said valve stem.

12. The valve lifter according to claim 10, wherein said valve lifter includes a main body formed to include an opening within a central portion of said main body, said lost motion mechanism being disposed for reciprocation within the central portion of said main body in a direction substantially orthogonal to said stem of said poppet valve.

13. The valve lifter according to claim 12, wherein said main body extends a predetermined distance between a cam and a stem of a poppet valve and said distal end of said valve lifter is disposed below said peripheral groove in a state wherein the spring is freely extended.

14. The valve lifter according to claim 10, wherein said lost motion mechanism includes a plunger holding body and a plunger operatively disposed to be slidable within said plunger holding body, said plunger being displaced to slide within said plunger holding body in response to hydraulic pressure being applied thereto.

15. The valve lifter according to claim 14, and further including a means for biasing said plunger to a predetermined position for enabling a stem to pass through a stem passing hole in said plunger holding body to not permit the transmission of motion from a cam to a poppet valve.

16. The valve lifter according to claim 15, wherein a predetermined hydraulic pressure applied to said plunger imparts sliding movement thereto to block a stem from passing through a stem passing hole in said plunger holding body to permit transmission of motion from a cam to a poppet valve.

17. The valve lifter according to claim 10, wherein said valve lifter includes an aperture for communicating hydraulic pressure from said peripheral groove to said lost motion mechanism.

18. The valve lifter according to claim 10, and further including an adjusting piece disposed between said valve lifter and said lost motion mechanism.

* * * * *